US006816185B2

(12) United States Patent
Harmath

(10) Patent No.: US 6,816,185 B2
(45) Date of Patent: Nov. 9, 2004

(54) SYSTEM AND METHOD FOR JUDGING BOUNDARY LINES

(76) Inventor: Miki Harmath, 99 Bogert Avenue, Toronto, Ontario (CA), M2N 1K5

( * ) Notice: Subject to any disclaimer, the term of this patent is extended or adjusted under 35 U.S.C. 154(b) by 333 days.

(21) Appl. No.: 09/750,995

(22) Filed: Dec. 29, 2000

(65) Prior Publication Data

US 2002/0122115 A1 Sep. 5, 2002

(51) Int. Cl.[7] ..... H04N 7/18; G08B 23/00; G08B 31/00

(52) U.S. Cl. ..... 348/157; 340/323 R; 340/384.1

(58) Field of Search ..... 348/157, 169, 348/154–155, 159; 340/323 R, 33 D, 815.4, 384.1

(56) References Cited

U.S. PATENT DOCUMENTS

| | | | | |
|---|---|---|---|---|
| 4,004,805 A | | 1/1977 | Chen et al. | |
| 4,365,805 A | * | 12/1982 | Levine | 473/467 |
| 4,432,058 A | | 2/1984 | Supran | |
| 4,545,576 A | * | 10/1985 | Harris | 473/468 |
| 4,718,669 A | | 1/1988 | Carlton et al. | |
| 4,866,414 A | | 9/1989 | Diaconu et al. | |
| 4,867,449 A | | 9/1989 | Carlton et al. | |
| 4,893,182 A | | 1/1990 | Gautraud et al. | |
| 5,082,263 A | | 1/1992 | Berger | |
| 5,138,322 A | | 8/1992 | Nuttall | |
| 5,150,895 A | | 9/1992 | Berger | |
| 5,489,886 A | | 2/1996 | Wexler et al. | |
| 5,800,292 A | * | 9/1998 | Brace | 473/467 |
| 5,808,695 A | * | 9/1998 | Rosser et al. | 348/584 |
| 5,908,361 A | | 6/1999 | Fisher et al. | |
| 5,923,365 A | * | 7/1999 | Tamir et al. | 348/169 |
| 6,024,658 A | | 2/2000 | Marshall | |
| 6,233,007 B1 | * | 5/2001 | Carlbom et al. | 348/157 |

FOREIGN PATENT DOCUMENTS

| | | |
|---|---|---|
| CA | 1025995 | 2/1978 |
| CA | 1168667 | 6/1984 |
| CA | 1244902 | 11/1988 |
| CA | 1278372 | 12/1990 |
| CA | 2038898 | 9/1992 |
| CA | 2048076 | 3/1996 |
| CA | 2213485 | 8/1996 |
| CA | 2248069 | 9/1996 |
| CA | 2113493 | 2/1999 |
| CA | 2228679 | 8/1999 |
| DE | 19954504 | 6/2000 |
| GB | 2357207 | 6/2001 |
| WO | WO 96/04047 | 2/1996 |

OTHER PUBLICATIONS

"Fundamentals of Digital Image Processing," Anil K. Jain, Prentice Hall Information and System Science Serice, Chapter 7, pp. 233–255.

"A Survey of the Hough Transform," J. Illingworth and J. Kittler, Academic Press, Inc., 1988, pp. 87–115.

"Ball Tracking and Virtual Replays for Innovative Tennis Broadcasts", Pingali, G., et al.

"Real Time Tracking for Enhanced Tennis Broadcasts", Pingali, G. S., et al.

* cited by examiner

*Primary Examiner*—Gims Philippe
(74) *Attorney, Agent, or Firm*—Cowan, Liebowitz & Latman, P.C.; R. Lewis Gable

(57) ABSTRACT

There is provided a new and useful system for judging boundary lines on a court in sporting games, for determining whether a ball in play bounces in or out of court. The system comprises at least one camera to capture as frames movement of the ball and a frame grabber associated with each of the cameras to process the frames. An image processing system is configured to receive the digitized frame from the frame grabbers and to process the digitized frame to determine whether the ball is in or out of court and to generate a signal if the ball is out of court. There is an output device coupled to the image processing system to receive the signal and alert the players.

33 Claims, 9 Drawing Sheets

(Singles)

(Doubles)

* In / Out for Reset #1 - according to pre setting, Figure 3 for singles and Figure 4 for doubles

SYSTEM AND METHOD FOR JUDGING BOUNDARY LINES

FIELD OF THE INVENTION

This invention relates to a system for judging boundary lines in sporting events, such as tennis, for automatic officiating of the game.

BACKGROUND OF THE INVENTION

Today, all sporting games involving rules around boundaries depend on the (often-controversial) decisions of human judges. Unfortunately, as technology has helped the athlete and even the causal player perform at greater levels, a human being's ability to judge a boundary line has not increased. Thus, at the competitive level there has been an increasing frequency in such controversial decisions.

For the recreational athlete, a game like tennis relies on the player making the in or out call at the boundary line and the opposing player trusting that call. This is unfortunately fraught with difficulties and many players feel the overwhelming need to cheat, or indeed to accuse their opponent of cheating.

In either case, there exists a strong need for a commercially viable system for judging the boundary lines in such a game. Since it can readily be appreciated that these problems are not unique to the game of tennis, a system which could work for other sports with little or no modification would be highly desirable. Also, in order to be commercially viable, especially at the competitive level, such a system must not require any changes to the court, the players' equipment or the ball and must not intrude upon the play of the game itself.

The applicant is aware of several attempts to design and patent a system, each of which appears to have had little if any commercial success and each of which suffers from significant deficiencies.

One such system is described in U.S. Pat. No. 5,489,886 of Wexler et al. That system requires up to 30 specially designed cameras to monitor the court and feed data into a processor. Given the huge amount of data generated by 30 such cameras, a super computer would be required. The Wexler et al. system also requires a camera placed under the net, in addition to the camera placed on each of the lines, which could interfere with the normal play of the game. The cost of such a system, if it worked, would be prohibitive to all but the hosts of the world's largest tournaments, such as Wimbledon. To the applicant's knowledge, however, this system did not work, and has never worked acceptably because of the lack of a suitable computer processor for the task.

Other examples known to the applicant include U.S. Pat. No. 4,432,058 of Supran, which requires that the ball be conductive and the court be equipped with electrical circuits, U.S. Pat. No. 4,866,414 of Diaconu et al. which requires the players to adapt their shoes and socks to the system and U.S. Pat. No. 4,893,182 of Gautrand et al., which is designed for a static scene such as a bowling alley and thus would not function in a high speed game such as tennis.

It is therefore an object of the present invention to provide a system and method for judging boundary lines, which system is capable of processing and interpreting the movements of objects (most often balls), at potentially high speeds, thus enabling the automatic overseeing and judging of sporting games. The system can be used for many different types of games, from tennis, volleyball, soccer or hockey, to sports not involving balls but requiring the clear identification of boundaries. The process can be adopted to evaluate and judge the adherence to the given rules of a sport.

SUMMARY OF THE INVENTION

In one aspect of the invention there is provided a system for judging boundary lines on a court in sporting games, for determining whether a ball in play bounces in or out of court. The system comprises at least one camera to capture movement of the ball and a frame grabber associated with each of the cameras to process the movement as captured frames. An image processing system is configured to receive the captured frame from the frame grabbers and to process the captured frame as images to determine whether the ball is in or out of court and to generate a signal if the ball is out of court. There is an output device coupled to the image processing system to receive the signal and alert the players.

In another aspect of the invention, the cameras are equipped with auto-iris lenses to automatically adjust the aperture of the cameras.

In another aspect of the invention, the camera may be color or high speed black and white.

In another aspect of the invention, the image processing system comprises a calibration sub-system and a recognition sub-system.

In another aspect of the invention, the calibration sub-system comprises a line recognition module, an image segmentation and region grouping module, a court line and region registration module, a supervised ball recognition module and a look-up-table module.

In another aspect of the invention, the recognition sub-system comprises a frame/sequence control module, a motion tracking module, an unsupervised automatic ball recognition module, a trajectory fitting module, a bounce detection module and an in/out judge module.

In another aspect of the invention, there is provided a method of judging boundary lines on a court in sporting games in order to determine whether a ball in play bounces in or out of court in which the method utilizes at least one camera to capture movement of the ball, a frame grabber associated with each of the cameras to process the movement as captured frames and an image processing system configured to receive the captured frame from the frame grabbers and to process the captured frame. The method comprises the steps of:

- selecting a mode of game using an input device configured so as to control the system and commence a recognition sub-system;
- during play of the game, continuously capturing image frames from the frame grabbers;
- within the image frames locating and isolating moving objects;
- comparing the moving objects to a calibrated image of the ball so as to filter out any moving object which is not the ball;
- fitting a path of the ball into a connected trajectory;
- detecting a spot on the court where the ball bounces by locating within the trajectory a sudden change in direction and by fitting or calculating the coordinates of the bounce;
- determining whether the ball is in or out of court;
- transferring a signal to an output device if the ball is determined to be out of court.

BRIEF DESCRIPTION OF THE DRAWINGS

These and other advantages of the invention will become apparent upon reading the following detailed description and upon referring to the drawings in which.

Figure 1:
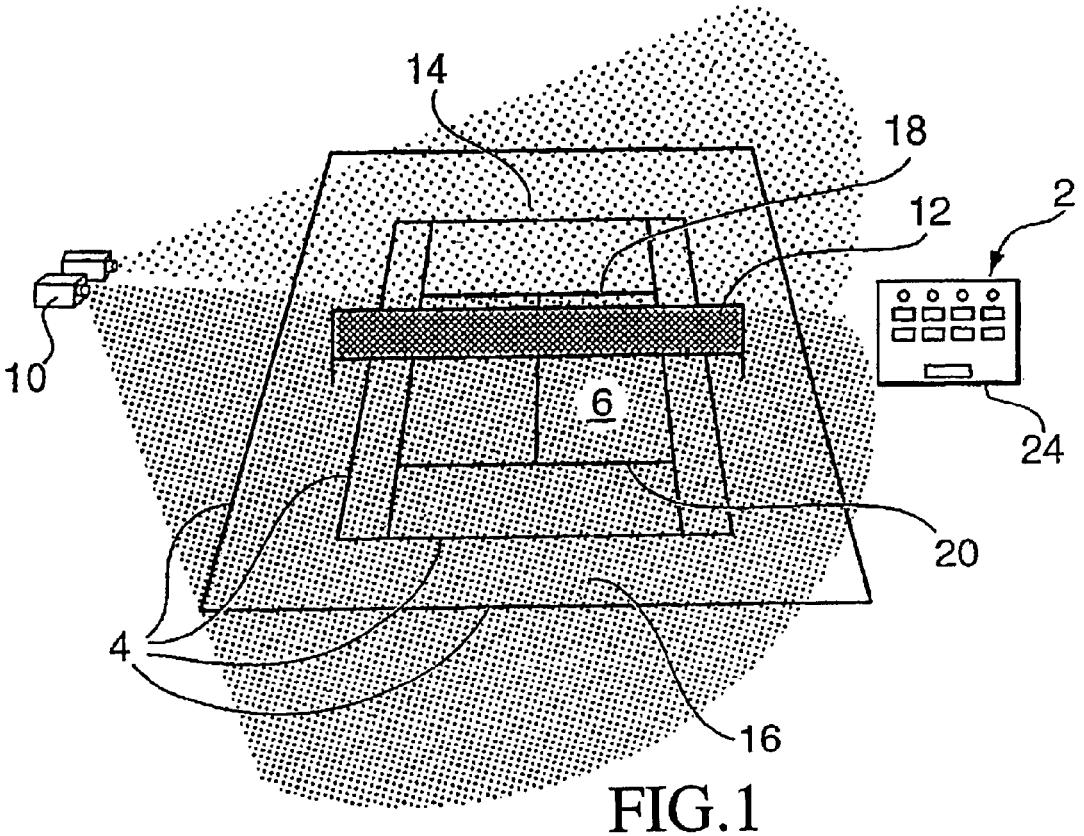
FIG. 1 is a perspective view of an embodiment of the invention, in situ at a tennis court.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to the drawings, FIG. 1 illustrates a system 2 for judging boundary lines 4 on a court 6, illustrated for the purposes of this application as a tennis court, for determining whether a ball (not shown) in play on the court 6 bounces in or out of play. Although a tennis court has been illustrated, it will be apparent to those skilled in the art that the system may be used for many different types of games, from tennis, volleyball, soccer or hockey, to sports not involving balls but requiring the clear identification of boundaries.

The system 2 comprises color or high speed black and white cameras 10 mounted near the court 6 in such a way that the field of view of the cameras 10 covers the boundary lines 4 of the court 6. One possible location for positioning the cameras 10 is in line with the net 12 at the centerline of the court 6, so that two cameras 10 may be used, one to cover each side 14,16 of the court 6. Preferably, the cameras 10 would be mounted approximately 3 to 5 meters above court level. The cameras 10 may also be mounted in line with the service lines 18, 20 on respective sides 14, 16 of the court 6. Alternate placement for the cameras would be possible, in order to maximize the field of view of the cameras 10, while minimizing the number of cameras required. It is contemplated that two cameras would be preferable, but up to four cameras would also be possible.

The cameras 10 are preferably equipped with auto-iris lenses which automatically adjust the aperture of the lens. This allows for consistent shutter speed even when the ambient light may change, for example direct sun vs. shadow, or sunlight vs. artificial light.

Black and white or color cameras could be used for recreational clubs and games where the speed of play is not as high as in professional tournaments. For the latter application, a black and white system will be preferable using progressive scan technology to provide sharper images.

A frame grabber which is associated with each camera 10 in order to convert the image into computer readable form captures the image from the camera 10. The captured image can then be manipulated by the image processing system in the manner described more fully below.

Figure 2:
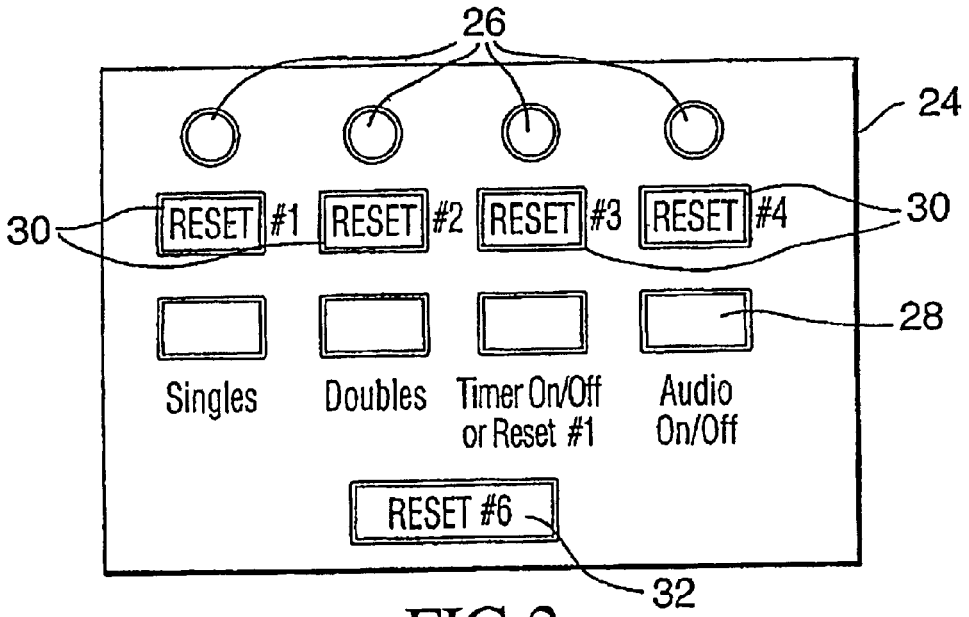
FIG. 2 is a front plan view of control panel of the present invention.

The cameras 10 are electronically linked to a control panel 24, which control panel may house the image processing system, as well as the control buttons and output indicators to relay an out signal to the players. As seen in FIG. 2, the output devices can be indicator lights 26 or an audio indicator, illustrated by button 28. The function of the reset buttons 30 and the general reset button 32 shown on the control panel 24 will be described in more detail below. The control panel 24 can be remote, remote touch screen, voice command, attached or built-in.

Figure 3:
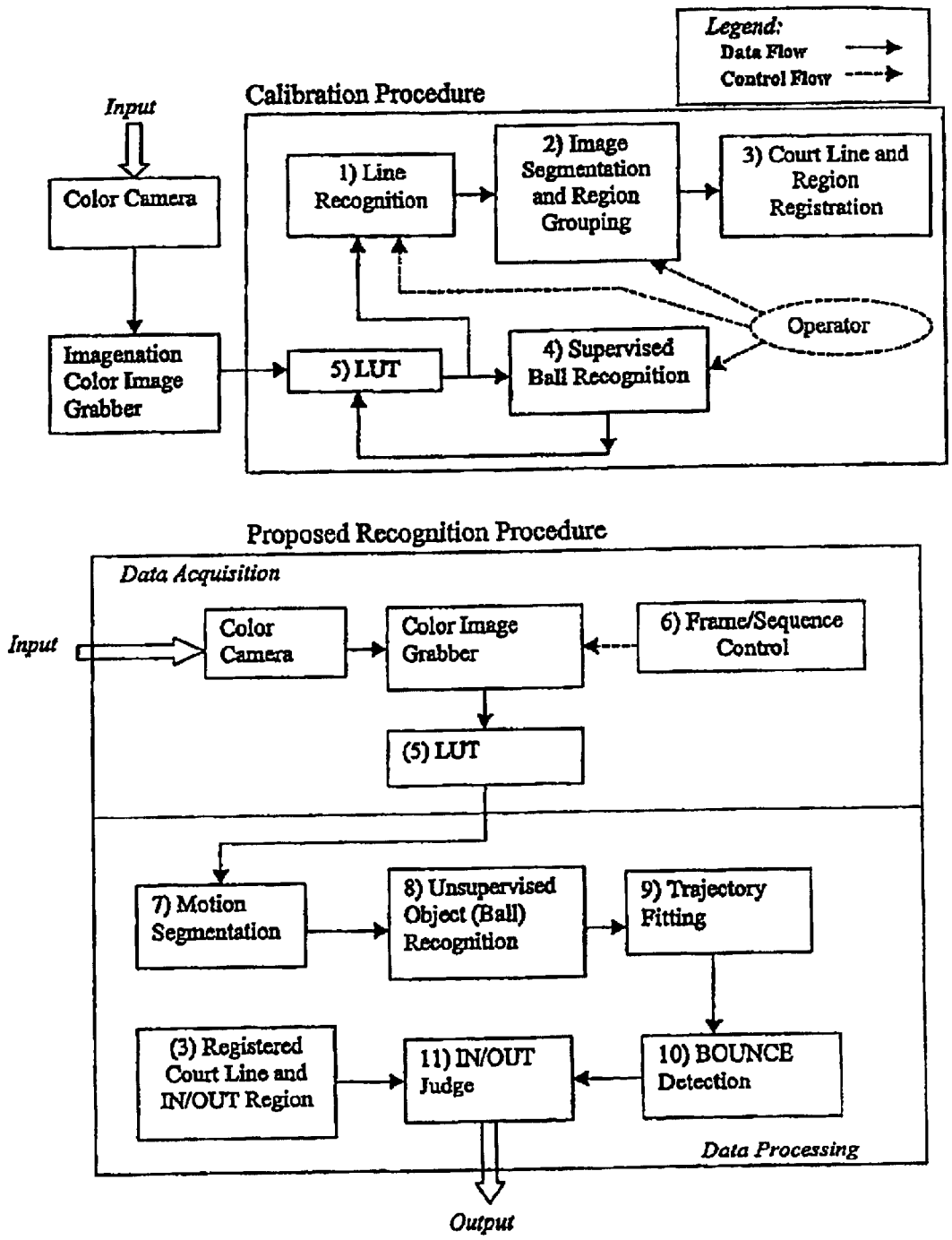
FIG. 3 is a block diagram of the image processing system of the present invention.

With reference to the block diagram of the image processing system shown in FIG. 3, it can be seen that the processing system is divided into 2 principle parts, the calibration sub-system and a recognition sub-system. The block diagram indicates the data flow and logic flow within the two sub-systems.

In the embodiment shown for use on a tennis court, the calibration sub-system is comprised of a line recognition module, an image segmentation and region grouping module, a court line and region module, a supervised ball recognition module and look-up table module.

The calibration sub-system is a supervised process, which occurs whenever the camera parameters are changed. Its purpose is to register the positions of boundary lines 4, namely the sidelines, the service lines and base lines of the court 6 so that the processing system may determine whether the ball is "in" or "out" in operation of the system. The processing system will recognize all the boundary lines in the image in off-line (non-real time) mode. Then the operator will use a pointing device, such as a mouse, to select the lines that correspond to the sidelines and base lines of the court. Under normal circumstances, a single calibration is all that is required, unless the camera parameters have changed.

The line recognition software module is configured to recognize lines (for example, tennis court lines) in the images. Ideally the lines should be straight. However, due to possible camera distortion (for example, an image resulting from a wide angle) and possible noise or interference, the lines can appear to be broken curve segments in the digital images. The edge detection method, which uses a set of curve partitioning and grouping rules based on the perceptual organization of descriptive curve features, is therefore adopted. It tracks curve segments and joins them into an appropriate form of a curve structure according to its topological and geometrical properties. It also takes into consideration all variable lighting conditions. The operator will nonetheless be able to correct possible errors in the automatic recognition and identify the correct lines.

Once the sidelines and the base lines of the court are correctly recognized, the image segmentation and region grouping module is configured to record the in and out areas of the court based on input from the user.

Figure 4:
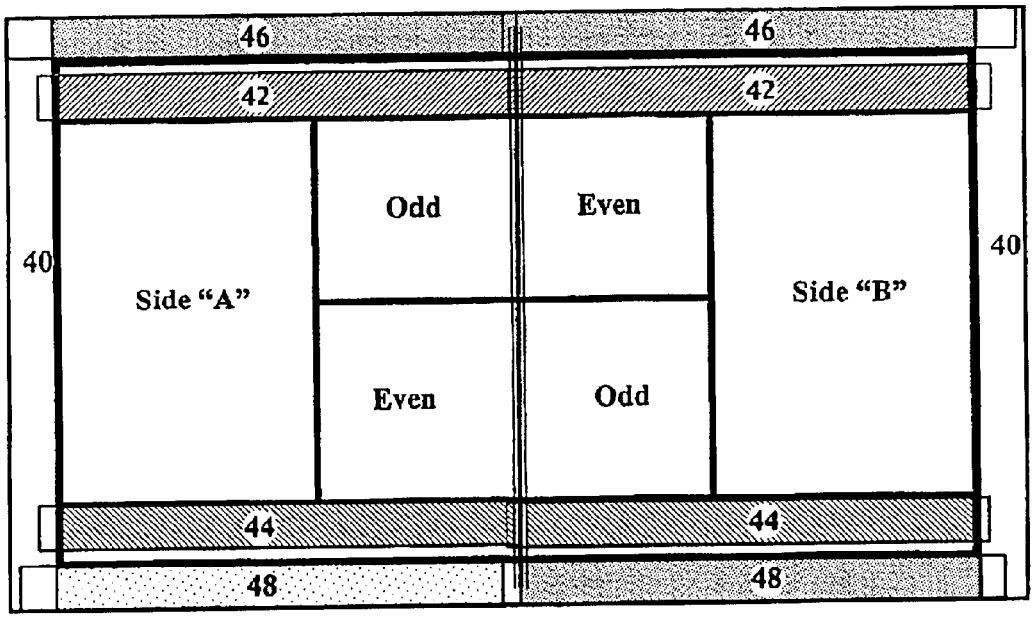
FIGS. 4 to 10 are alternate schematic views of a mapped tennis court for use with the embodiment of the invention shown in FIG. 1.
Figure 5:
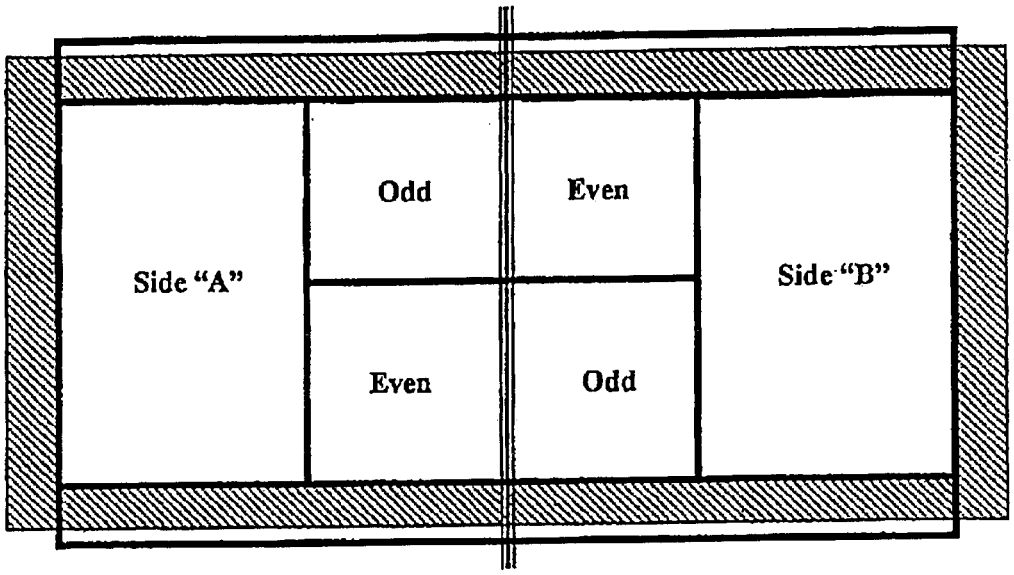
Figure 6:
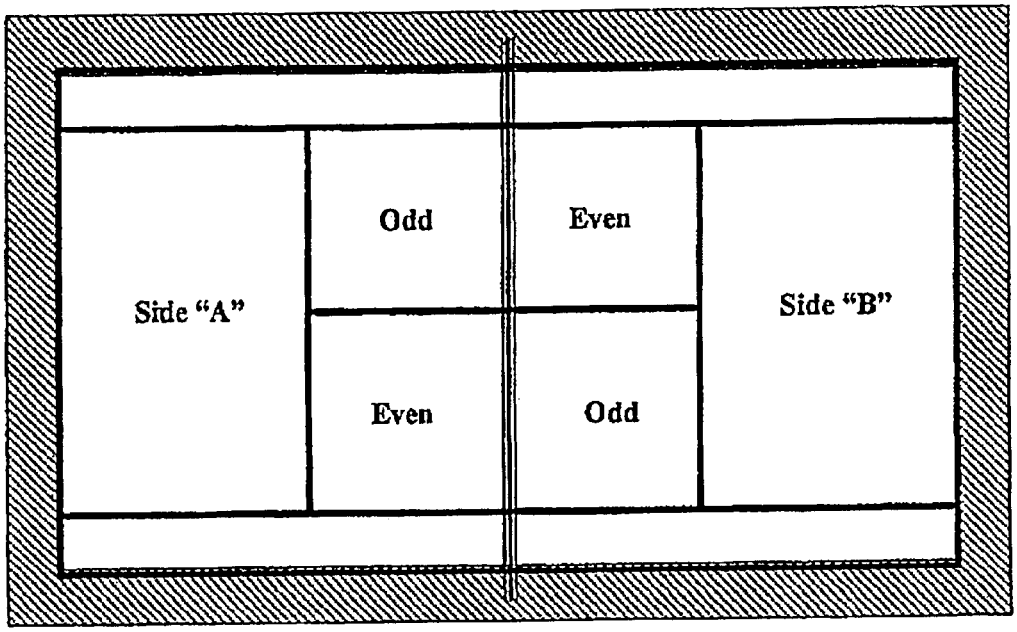
Figure 7:
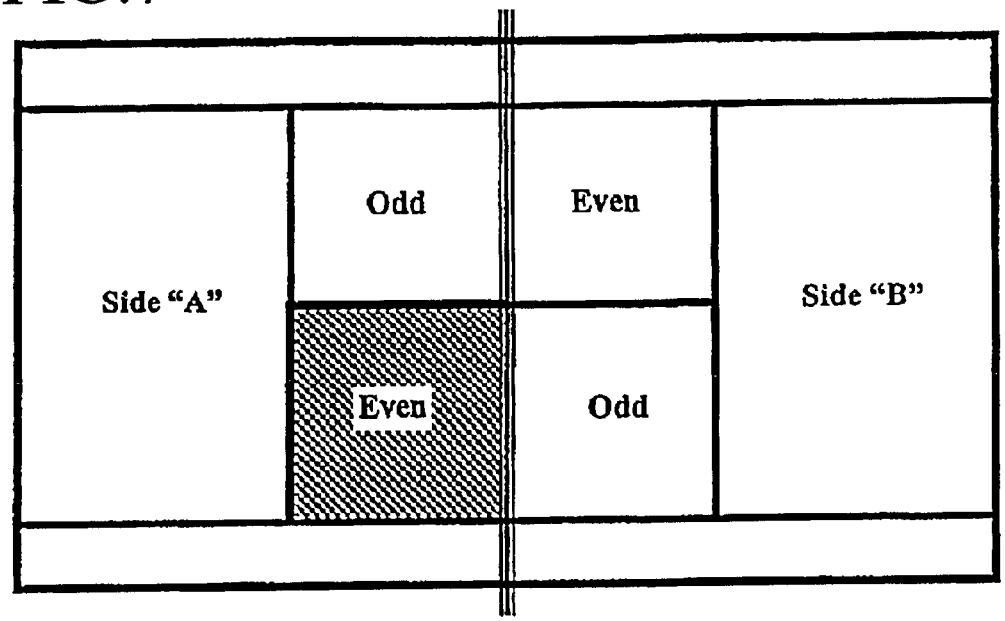
Figure 8:
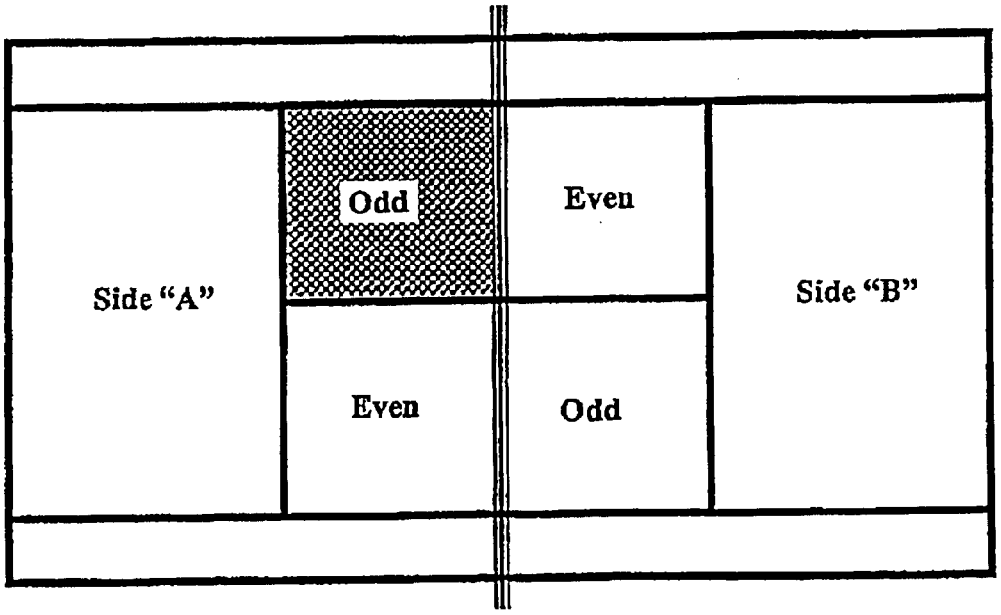
Figure 9:
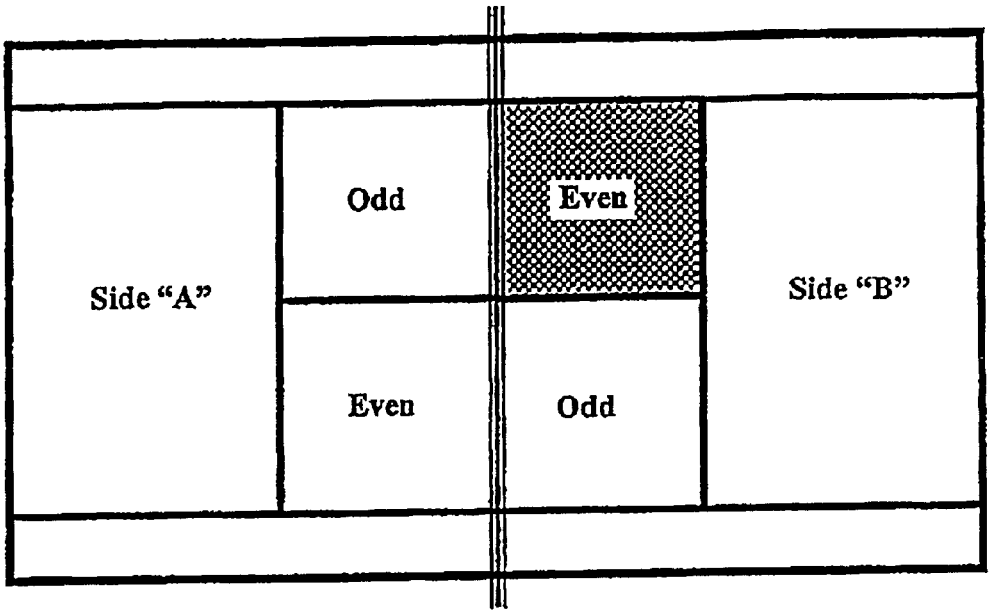
Figure 10:
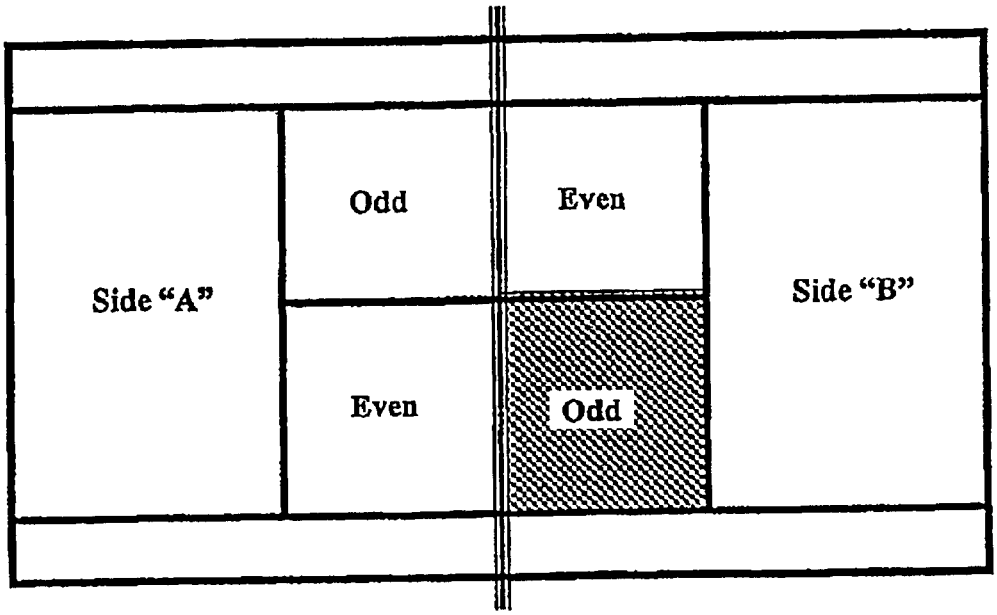

The court line and region registration module saves the locations of the "in" and "out" regions given by the previous process in its permanent memory (hard drive). Whenever the real-time tracking system starts up, it will first check these registered regions. These registered values are valid unless the camera parameters are changed. The camera parameters include extrinsic parameters (the camera position and orientation) and intrinsic parameters (focal length, lens distortion and CCD grid sizes). A typical court mapping is shown in FIG. 4. Each area shown is a minimum of 0.5 meters in length and as the court layout requires in length. Areas 40, 42 and 44 are considered in singles play and areas 40, 46 and 48 are considered in doubles play. Similarly, FIG. 5 shows the out areas after the initial serve in singles play and FIG. 6 shows the out areas after the initial serve in doubles play.

The supervised ball recognition module is another supervised process. In this process, a tennis ball will be put into the scene. The operator will click on the ball in the scene. The module is then configured to record the color or grey level range pattern of the ball.

The look-up-table module is configured to transform input image data into output data. For gray level frame grabbers, it is a 256-bytes table; for true color frame grabbers, the look-up table module is implemented as a mapping function. The purpose of applying the look-up table module is to maximize the intensity of the tennis ball while minimizing the intensity of the stationary background in the process of recognition. Hardware based look-up table modules can make the real time tracking and recognition easier.

Once the calibration sub-system is complete, the system is ready for use. Such use is described in the block diagram of the recognition sub-system, shown in FIG. 3. In the embodiment shown, the recognition sub-system comprises a frame/sequence control module, a motion tracking module, an unsupervised automatic ball recognition module, a trajectory-fitting module, a bounce detection module and an in/out judge module.

The frame/sequence control module is configured to control the image grabbing timing in order to obtain continuous image frames from the frame grabbers. It is desirable, but not mandatory, that a complete or almost complete image sequence is captured both for recognizing the tennis ball and for locating the trajectory (course) of the ball.

The motion-tracking module is configured to be triggered by any moving objects within the image sequence captured for the scene. The module is then configured to locate and isolate any moving objects from the background in the image frames. All objects found under motion will be passed to the ball recognition module.

The unsupervised automatic ball recognition module is based on the supervised ball calibration and the result of motion tracking. The module is configured to recognize all moving objects that are potentially tennis balls in the images. Unrelated moving pattern (possibly a tennis player, or, a bird that happens to fly by) should be filtered out.

At this stage in the process, the motion-tracking module and the unsupervised ball recognition module have captured a complete or almost complete course of the tennis ball. However, due to the camera view being blocked by a player or to the use of different shutter speed, there may be broken parts of the trajectory. Thus, the trajectory-fitting module is configured to fit the running course of the tennis balls into connected lines or curves.

Using the shape of the ball's trajectory, the bounce detection module is configured to detect the spot of bouncing by finding the sudden change of direction in the trajectory or by calculation, which is considered as the bouncing point on the ground of the tennis ball.

The bounce is then passed to the in/out judge module, which is configured to determine whether the bounce is in or out based on a simple set of rules. Such rule set may include:

if the bouncing spot overlaps with side lines or base lines, and inside the region that is registered in calibration, it is "in"; or if the bouncing spot does not overlap with the lines, and outside the registered region, it is "out".

Figure 11:
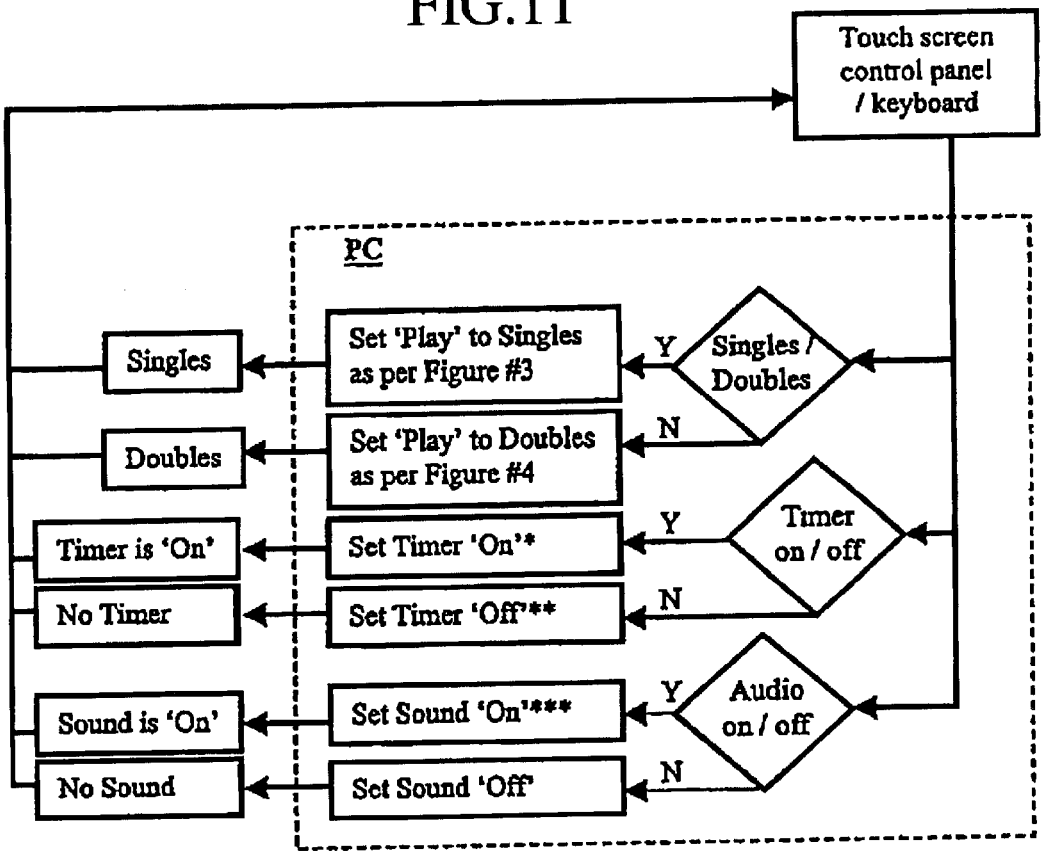
FIG. 11 is a logic flow diagram for setting functions of the image processing system before use of the embodiment of the invention shown in FIG. 1.

FIG. 11 illustrates the logic flow for presetting the system before play of the match begins, using the control panel. This will not change during the match, unless the players or the administrator (tournament) override the initial settings. These functions have to be set before starting a tennis match and likely not change until finished. The Singles/Doubles—sets the system to scan either as singles (FIG. 5) or doubles (FIG. 6) after the serve or according to timer if timer setting is 'ON'. The timer option gives the flexibility for setting the system to monitor the court in either singles or doubles mode simultaneously without issuing any additional command (Reset #1 on FIG. 12. The logic flow diagrams 13 would thus no longer be applicable to the operation of the system). The system will indicate if a ball bounces OUT, pauses for 5 sec while keeping the indicator ON, then starts monitoring again. If this option is chosen the system only monitors as shown in FIG. 5 or 6 and does not monitor the service areas, FIGS. 7 through 10. Therefore the service lines would have to be judged by the players. This is a very convenient way for clubs using the system on several tennis courts—once the system is set to this option it does not need any further adjustment and will watch the lines uninterrupted.

Figure 12:
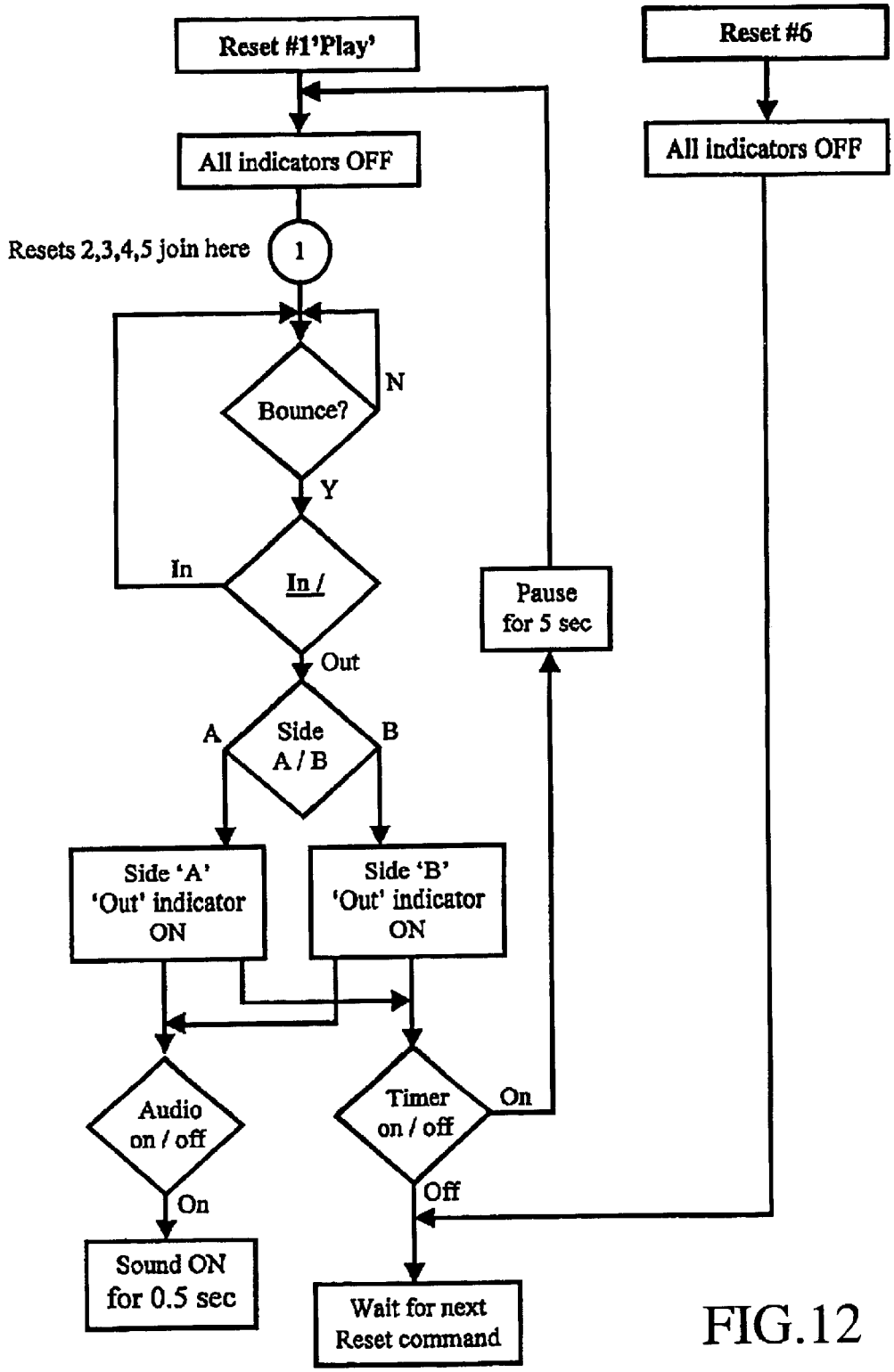
FIGS. 12 and 13 are alternate logic flow diagrams for the image processing system during play of the game.
Figure 13:
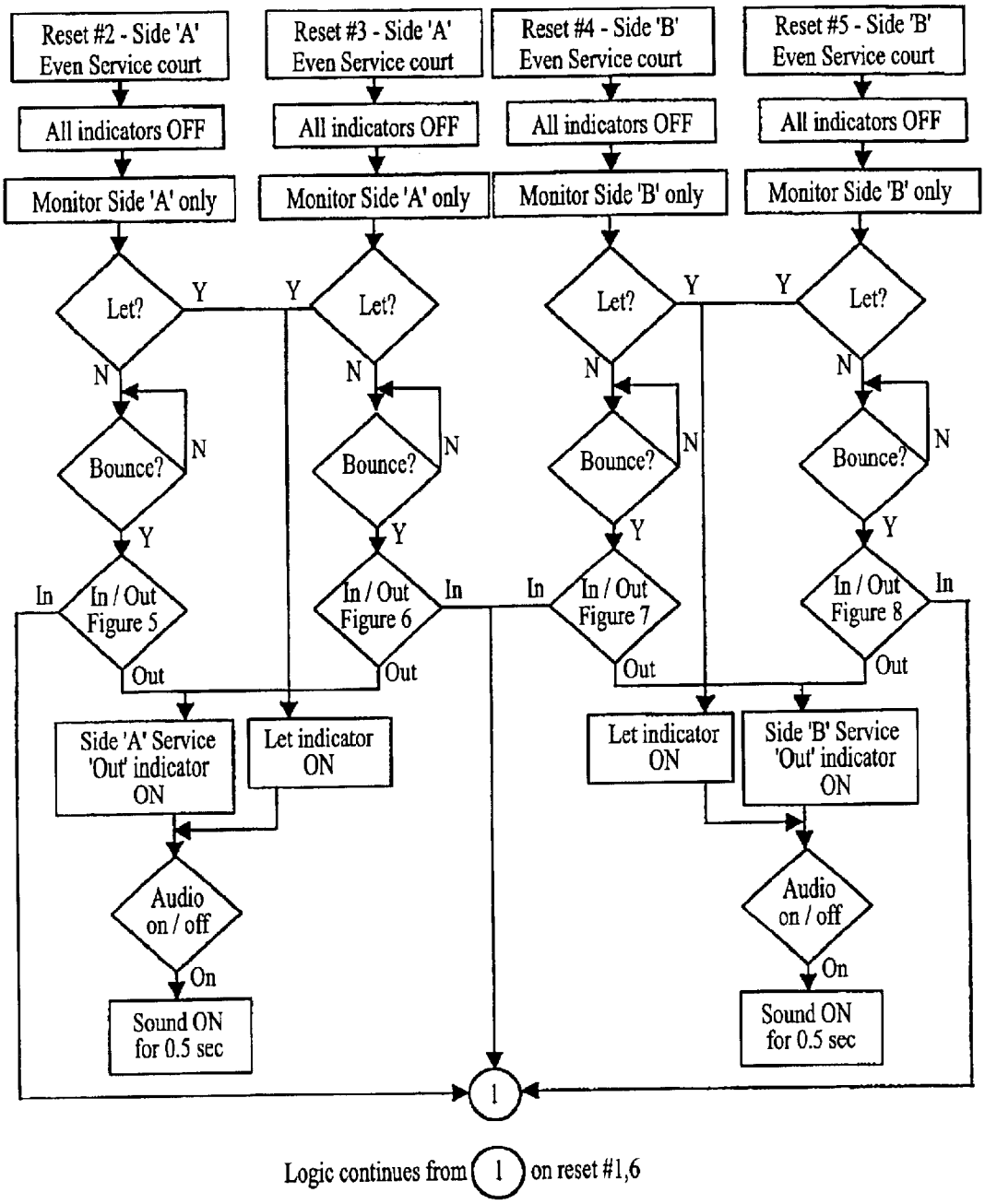

If the timer function is set to off, then the system functions according to the logic shown in FIGS. 12 and 13. In that mode, i.e. timer function deactivated, it is preferable to have a voice command at the control panel in order to reset the system for the next rally. For tournaments, the system should be monitored by an administrator, by the chair umpire or a by line judge to ensure proper system setting after each out has been recorded, or to be hooked up to the official scoreboard (see the table on page 15).

FIG. 12 illustrates the logic flow for the system monitoring the court after the service, according to the mode chosen, singles or doubles, i.e. FIG. 5 or FIG. 6 (or reset #1 (play) if timer mode is preferred). The system monitors the court until an OUT occurs, turns the appropriate indicator on, keeps it on and waits for the next reset command. The reset #6 command turns all indicators off and waits for the next reset command. If the audio function is set "on", in addition to the out indicators, a short (0.5 sec ) sound will be given upon an OUT.

FIG. 13 illustrates the logic flow for the system when set to monitor the service areas, as shown in FIGS. 7 to 10 and continues from FIG. 12, at "1".

In Reset #2, the serve is coming from side 'B' and should bounce in side 'A' even service court. The system looks for the first bounce on side 'A'. If the bounce was inside the even service court, including the lines (FIG. 7), the system starts monitoring according to the preset singles/doubles option, as on FIG. 12, continuing from "1". If the first bounce was not in the even service court the side A service indicator will go on and will be kept on until the next reset command is issued.

Applicable scores and voice commands for this function include: 0:0; 15:15 'Fifteen all'; 30:30 'Thirty all'; 40:40 'Forty all'; 15:40 'Fifteen forty'; 40:15 'Forty fifteen'; deuce 'Deuce'. Preferably, the player will also be able to initiate a 'Reset #2' with the voice command 'A even' (for tiebreaker etc.)

In Reset #3, the serve is coming from side 'B' and should bounce in side 'A' odd service court. The system looks for the first bounce on side 'A'. If the bounce was inside the odd service court, including the lines (FIG. 8), the system starts monitoring according to the preset singles/doubles option. If the first bounce was not in the odd service court the side A service indicator will go on and will be kept on until the next reset command is issued.

Applicable scores and voice commands include: "15:0 'Fifteen love'; 0:15 'Love fifteen'; 30:15 'Thirty fifteen'; 15:30 'Fifteen thirty'; 40:30 'Forty thirty'; 30:45 'Thirty forty'; ad in (advantage in) 'Ad in'; ad out (advantage out) 'Ad out'. The player will also be able to initiate a 'Reset #3' with the voice command 'A odd' (for tiebreaker etc.)

In Reset #4, the serve is coming from side 'A' and should bounce in side 'B' even service court. The system looks for the first bounce on side 'B'. If the bounce was inside the even service court, including the lines (FIG. 9), the system starts monitoring according the preset singles/doubles option. If the first bounce was not in the even service court the side B service indicator will go on and will be kept on until the next reset command is issued.

Applicable scores and voice commands include: 0:0; 15:15 'Fifteen all'; 30:30 'Thirty all'; 40:40 'Forty all'; 15:40 'Fifteen forty'; 40:15 'Forty fifteen'; deuce 'Deuce'. The players will also be able to initiate a 'Reset #4' with the voice command 'B even' (for tiebreaker etc.)

In Reset #5, the serve is coming from side 'A' and should bounce in side 'B' odd service court. The system looks for the first bounce on side 'B'. If the bounce was inside the odd service court, including the lines (FIG. 10), the system starts monitoring according the preset singles/doubles option. If the first bounce was not in the odd service court the side B service indicator will go on and will be kept on until the next reset command is issued.

Applicable scores and voice commands include: 15:0 'Fifteen love'; 0:15 'Love fifteen'; 30:15 'Thirty fifteen'; 15:30 'Fifteen thirty'; 40:30 'Forty thirty'; 30:45 'Thirty forty'; ad in (advantage in) 'Ad in'; ad out (advantage out) 'Ad out'. The players will also be able to initiate a 'Reset #5' with the voice command 'B odd' (for tiebreaker etc.)

In a preferred embodiment therefore, two cameras 10 monitor the two sides of the court 6. Before the match begins, the players choose the mode (singles/doubles), set the timer on or off and set the audio on or off. Also, the players will be able to choose voice command or manual commands for the reset functions.

The cameras 10 then monitor play on the court and frame grabbers (one per camera) digitize the image for the processing system. The moving objects within the image are isolated and, comparing the objects to the calibrated image of the ball, all but the ball are filtered out. The path of the ball is then fitted into a connected trajectory and, by locating a sudden change in the direction of the trajectory, the bounce of the ball is detected. Following the logic flows set out above, the bounce is determined to be in or out, and if out, a signal is triggered on the control board. The board then actuates the appropriate audible and/or visual cue to indicate that the ball bounced out of court. The system is then reset manually or by a timed reset and continues to monitor the court.

It will be readily apparent to the skilled person in the art that where the system is being used in tennis matches involving a chair umpire, or other activities involving an official overseeing the game, the control board and reset functions can easily be monitored and controlled by that umpire or official. Thus, the use of the timer and audible functions are optional.

In matches where the players are on their own, the combination of the timer function and the audible signal allow play to continue relatively unabated. Indeed, the system can have its own independent scoreboard or can be hooked up to the official scoreboard at the court. The following chart represents sample scoreboard/reset logic for automatic resetting of the system in response to a scoreboard change:

| | Player 1 | Player 2 | Reset # - serving from side 'A' | Reset # - serving from side 'B' |
|---|---|---|---|---|
| Score | 0 | 0 | 4 | 2 |
| | 15 | 0 | 5 | 3 |
| | 30 | 0 | 4 | 2 |
| | 40 | 0 | 5 | 3 |
| | 0 | 15 | 5 | 3 |
| | 0 | 30 | 4 | 2 |
| | 0 | 40 | 5 | 3 |
| | 15 | 15 | 4 | 2 |
| | 30 | 15 | 5 | 3 |
| | 40 | 15 | 4 | 2 |
| | 15 | 30 | 5 | 3 |
| | 15 | 40 | 4 | 2 |
| | 30 | 30 | 4 | 2 |
| | 40 | 30 | 5 | 3 |
| | 30 | 40 | 5 | 3 |
| | 40 | 40 | 4 | 2 |
| | Deuce | Deuce | 4 | 2 |
| | A | | 5 | 3 |
| | | A | 5 | 3 |
| Tiebreaker even count | | | 4 | 2 |
| Tiebreaker odd count | | | 5 | 3 |

Thus, it is apparent that there has been provided in accordance with the invention a system and method for judging boundary lines that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim:

1. A system for judging boundary lines on a court in sporting games for determining whether a ball in play bounces in or out of court; said system comprising:

at least one camera positioned proximate to the court independent of the orientation of said boundary lines to capture movement of said ball;

a frame grabber associated with each of said at least one cameras to process said movement of said ball as captured frames;

an image processing system configured to receive said captured frame from said frame grabbers and to process said captured frame as images to determine whether said ball is in or out of court and to generate a signal if said ball is out of court, said image processing system comprising a calibration sub-system and a recognition sub-system, wherein said calibration sub-system comprises a line recognition module, an image segmentation and region grouping module, a court line and region registration module, a supervised ball recognition module and a look-up-table module; and an output device coupled to said image processing system to receive said signal.

2. The system of claim 1 wherein said line recognition module is configured to recognize and record said boundary lines in said images, using a method of edge detection to correct for distortions.

3. The system of claim 1 wherein said image segmentation and region grouping module is configured to record in and out areas of the court based on input from the user.

4. The system of claim 1 wherein said court line and region registration module is configured to save in and out areas of the court in permanent memory to be used as a comparison point each time the system is commenced.

5. The system of claim 1 wherein said supervised ball recognition module is configured record as a calibrated image a color pattern of the ball placed in the image.

6. The system of claim 1 wherein said look-up-table module is configured to transform input data into output data.

7. The system of claim 6 wherein said look-up-table module is configured as a 256 bytes table.

8. The system of claim 6 wherein said look-up-table module is configured as a mapping function.

9. A system for judging boundary lines on a court in sporting games for determining whether a ball in play bounces in or out of court; said system comprising:

at least one camera positioned proximate to the court independent of the orientation of said boundary lines to capture movement of said ball;

a frame grabber associated with each of said at least one cameras to process said movement of said ball as captured frames;

an image processing system configured to receive said captured frame from said frame grabbers and to process said captured frame as images to determine whether said ball is in or out of court and to generate a signal if said ball is out of court, said image processing system comprising a calibration sub-system and a recognition sub-system, wherein said recognition sub-system comprises a frame/sequence control module, a motion-tracking module, an unsupervised automatic ball recognition module, a trajectory fitting module, a bounce detection module and an in/out judge module; and an output device coupled to said image processing system to receive said signal.

10. The system of claim 9 wherein said frame/sequence control module is configured to control timing of image capture such that continuous image frames are captured from said frame grabbers.

11. The system of claim 9 wherein said motion-tracking module is configured to locate and isolate moving objects within said image and pass said moving objects to the unsupervised automatic ball recognition module.

12. The system of claim 9 wherein said unsupervised automatic ball recognition module is configured to compare moving objects within said image to a calibrated image of said ball so as to filter out any moving objects which is not the ball, thereby leaving an image of the ball.

13. The system of claim 11 wherein said unsupervised automatic ball recognition module is configured to compare said moving objects within said image to a calibrated image of said ball so as to filter out any moving objects which is not the ball, thereby leaving an image of the ball.

14. The system of claim 9 wherein said trajectory fitting module is configured to fit a path of said ball into a connected trajectory.

15. The system of claim 13 wherein said trajectory fitting module is configured to fit a path of said ball into a connected trajectory.

16. The system of claim 9 wherein said bounce detection module is configured to detect a spot on the court where the ball bounces by locating a sudden change in the direction of the ball.

17. The system of claim 15 wherein said bounce detection module is configured to detect a spot on the court where the ball bounces by locating within said connected trajectory a sudden change in the direction of the ball.

18. The system of claim 9 wherein said in/out judge module is configured to determine whether the ball has bounced in or out of court.

19. The system of claim 17 wherein said in/out judge module is configured to determine whether the ball has bounced in or out of court by comparing the spot on the court where the ball bounces to the boundary lines and determining if the spot overlaps with the lines or does not overlap with the lines.

20. A system for judging boundary lines on a court in sporting games for determining whether a ball in play bounces in or out of court; said system comprising:

at least one camera positioned proximate to the court independent of the orientation of said boundary lines to capture movement of said ball;

a frame grabber associated with each of said at least one cameras to process said movement of said ball as captured frames;

an image processing system configured to receive said captured frame from said frame grabbers and to process said captured frame as images to determine whether said ball is in or out of court and to generate a signal if said ball is out of court;

an output device coupled to said image processing system to receive said signal; and an input device to select a mode of the game and selectively actuate and reset said system.

21. The system of claim 20 wherein said input device comprises voice activated commands.

22. The system of claim 20 wherein said input device comprises manually operable switches.

23. The system of claim 20 wherein said input device comprises remotely operable switches.

24. The system of claim 20 wherein said input device comprises remote touch screen operable switches.

25. The system of claim 20 wherein said input device comprises separate wire connected operable switches.

26. The system of claim 20 wherein said input device and said output device are housed within a single control unit.

27. The system of claim 20 wherein said output device comprises an audible cue, activated upon receipt of said signal.

28. The system of claim 20 wherein said output device is housed within a scoreboard.

29. The system of claim 20 wherein said output device is wired to an existing scoreboard.

30. The system of claim 20 wherein said output device comprises an visual cue, activated upon receipt of said signal.

31. A method of judging boundary lines on a court in sporting games in order to determine whether a ball in play bounces in or out of court, said method utilizing at least one camera to capture movement of said ball, a frame grabber associated with each of said at least one cameras to process said movement as captured frames and an image processing system arranged to receive said captured frame from said frame grabbers and to process said captured frame, said method comprising the steps of:

selecting a mode of game using an input device configured so as to control said system and commence a recognition sub-system;

during play of said game, continuously capturing image frames from said frame grabbers;

within said image frames locating and isolating moving objects;

comparing said moving objects to a calibrated image of said ball so as to filter out any moving object which is not said ball;

fitting a path of said ball into a connected trajectory;

detecting a spot on said court where the ball bounces by locating within said trajectory a sudden change in direction;

determining whether said ball is in or out of court;

transferring a signal to an output device if said ball is determined to be out of court.

32. The method of claim 31 further comprising an initial calibration sequence performed when said system is initially set up at said court or when configuration of said cameras has changed.

33. The method of claim 32 wherein said calibration sequence comprises the steps of recognizing and recording said boundary lines in said images, recording in and out areas of said court, saving said in and out areas in permanent memory, recording a color or grey level range pattern of said ball, and creating a look-up table to transform input data into output data.

* * * * *